US007329295B2

(12) United States Patent
Greene et al.

(10) Patent No.: US 7,329,295 B2
(45) Date of Patent: Feb. 12, 2008

(54) LIGHT WEIGHT BAGLESS VACUUM CLEANER

(75) Inventors: Mason Greene, Auburn, AL (US); Mark Rosenzweig, Chestnut Hill, MA (US)

(73) Assignee: Euro-Pro Operating, LLC, West Newton, MA (US)

( * ) Notice: Subject to any disclaimer, the term of this patent is extended or adjusted under 35 U.S.C. 154(b) by 666 days.

(21) Appl. No.: 10/802,389

(22) Filed: Mar. 17, 2004

(65) Prior Publication Data

US 2005/0223519 A1 Oct. 13, 2005

(51) Int. Cl.
*A47L 9/16* (2006.01)

(52) U.S. Cl. ..... 55/337; 55/433; 55/459.1; 55/DIG. 3; 15/353

(58) Field of Classification Search ..... 55/337, 55/426, 429, 433, 459.1, DIG. 3; 15/347–353, 15/DIG. 8

See application file for complete search history.

(56) References Cited

U.S. PATENT DOCUMENTS 4,571,772 A * 2/1986 Dyson ..... 15/335
5,307,538 A * 5/1994 Rench et al. ..... 15/352
6,406,505 B1 * 6/2002 Oh et al. ..... 55/337
6,546,593 B2 * 4/2003 Oh et al. ..... 15/353
6,848,146 B2 * 2/2005 Wright et al. ..... 15/353
2004/0098827 A1 * 5/2004 Oh et al. ..... 15/347

* cited by examiner

*Primary Examiner*—David Redding
(74) *Attorney, Agent, or Firm*—Greenberg Traurig LLP; Michael I. Wolfson

(57) ABSTRACT

A light weight upright vacuum container including a cylindrical cyclonic air separation and dirt collect container with a combination shroud and pleated filter cartridge holder. The container has a tangential air inlet at the upper portion, a closed bottom and an open top leading to a motor positioned in the upper portion of the vacuum cleaner housing provide for improved air separation and dirt collection. The shroud has an open sidewall and a closed bottom with an outwardly and downwardly extending skirt that extends to the about the midpoint of the height of the container. Dirt particles that separate from the air flow above the skirt drop to the lower portion below the skirt. Clean air then exits an open upper portion of the shroud to the suction source above the container. The air exiting the shroud passes through a frusto-conical region and into a radially pleated filter before entering the vacuum motor.

9 Claims, 4 Drawing Sheets

LIGHT WEIGHT BAGLESS VACUUM CLEANER

BACKGROUND OF THE INVENTION

The invention relates generally to vacuum cleaners, and more particularly to light weight upright bagless vacuum cleaners including a cylindrical cyclonic separation/dirt collection container with a combined central shroud and filter holder in the container and an outlet at the top of the container with an openable bottom to enhance separation of dirt from the air stream and retention of dirt particles on the bottom of the container.

Cyclonic vacuum cleaners have been known for some time. For example, European Patent No. EP 0 042 723 and U.S. Pat. No. 4,593,429 to James Dyson discloses a vacuum suction cleaning device including two cyclone units in series operating successively to extract dirt particles from an air flow. One of the two cyclones has a substantially frusto-conical shape serving to increase the velocity of the dirt particles so that the cyclone is capable of depositing the fine dust particles in a small diameter collection chamber relative to the diameter of the cone opening. Prior to the air entering the cyclone, dirty air enters tangentially against the wall of a cylindrical outer chamber operating as a cyclone to remove coarse dirt particles from the dirty air entering the device.

In addition to devices wherein the successive cyclones are coaxial as in the above noted publications, Dyson in U.S. Pat. No. 4,373,288 places frusto-conical cyclones side by side. In this configuration, the device is designed to remove dirt through the two cyclones operating in series. The principal objective in all these devices is to avoid the need to utilize a bag as in conventional vacuum cleaners. In these conventional devices, air is drawn through the appliance by a fan that creates a large pressure drop as the bag fills with dirt. This increase in pressure drop lowers the cleaning efficiency of the unit. It is for this reason that configurations for bagless vacuum cleaners are extremely appealing.

A bagless cleaning device is disclosed in WO 99/42198 based on PCT/GB99/00507 by the applicant herein. The full text of this publication is incorporated herein by reference. In this device, dirty inlet air is passed into the upper portion of a cyclone having a cylindrical cross-section and a lower frusto-conical section. This cyclone separation stage is designed to separate fine dirt particles in a collection chamber below the cone opening. The cylindrical portion of the device includes a transition zone connected to an adjacent side chamber for collection of coarse dirt particles. In another embodiment disclosed therein, coarse dirt is collected in an outer larger cylindrical chamber surrounding the inner frusto-conical cyclone separator.

Other bagless vacuum cleaner designs are shown in a series of related applications that issued to Royal Appliance Mfg. Co. based on an application that initially issued as U.S. Pat. No. 6,003,196 on Dec. 21, 1999. These patents disclose various types of upright vacuum cleaners including an air separation chamber that may be a cyclonic separation device. All the vacuum cleaners described in these patents include a filter disposed in the cyclonic air flow chamber or dirt cup upstream of the suction source.

U.S. Pat. No. 6,192,550 to Sanyo Electric Co., Ltd. also discloses a vacuum cleaning device having a rotatable filter disposed in a cyclonic air separation chamber. This device is particularly effective, because the rotatable feature of the filter allows removal of dirt entrained in the filter into the bottom of the dirt cup for easy disposal when the dirt cup is removed for cleaning. The contents of this patent are incorporated herein by reference.

While the use of cyclonic separators provides its own advantage, considerations related to the configuration of the vacuum cleaner as a whole may also affect the viability of the design. Motors used to power a fan to induce air flow tend to be the heaviest single component of the vacuum cleaner. The location of this weight may affect the ease with which the vacuum cleaner may be used. Where the weight of the motor is high relative to the rest of the components of the vacuum cleaner, the resultant high center of gravity for the vacuum may tend to make the assembly less stable for users. Thus, the ability to mount the motor low may offer additional stability and ease of use.

Mounting the motor below the separation chamber lowers the center of gravity of the vacuum cleaner that is important in a compact light weight design. The configuration affects design choices for the separation chamber. The use of a cyclonic separator requires that the chamber be substantially cylindrical, and of a sufficient diameter to allow for cyclonic air flow within. The separation chamber must be removable to allow it to be emptied, cleaned or replaced. Placement of the motor below the separation chamber may result in inefficient power to draw air entering the separation chamber at the top through the separation chamber.

Thus, while many of these bagless designs are improvements over conventional vacuums utilizing bag technology, it remains desirable to provide continued improvements and alternative designs to improve both the separation of dirt particles from air in the air separator chamber in a compact and light-weight design.

SUMMARY OF THE INVENTION

Generally speaking, in accordance with the invention, a light weight upright vacuum cleaner having a cylindrical dirt separation and collection device is provided. The dirt separation and collection device is a substantially cylindrical container with a tangential air inlet at the upper portion and a selectively operable bottom for removal of separated dirt. A combination shroud and filter holder extends from the open top of the container with an upper filter holder portion, a lower shroud extending into the container and a frusto-conical transition region connecting the shroud to the filter holder portion. An outwardly and downwardly extending flange or skirt extends from the bottom of the shroud to prevent reentrainment of dirt into the air stream exiting the container. The closed bottom of the container is pivotally mounted to the container sidewall and selectively openable for emptying.

A vacuum cleaner in accordance with the invention has an elongated housing hingedly connected to a nozzle with an air inlet for removing dirt from a surface to be cleaned. The housing has an upper end extending to a pipe with a user handle at the top of the pipe. The housing includes a container cavity that receives the separation and collection container. A motor is positioned in the upper portion of the housing above the container opening in the housing for receiving the air separation and dirt collection container. Outlet air is drawn from the container to a radially pleated filter disposed in the separate filter holder above the transition region and the shroud. A cylindrical radially pleated filter cartridge is positioned in the holder below the motor. Air entering the container tangentially circulates above the skirt depositing dirt to the bottom and is then drawn into the open portion of the shroud and the upwardly into the filter cartridge. The filter pleats are radially disposed to increase filtering surface area, before the clean air is drawn into the motor.

Accordingly, it is an object of the invention to provide a dirt separation container for a compact upright vacuum cleaner that provides improved dirt separation.

It is another object of the invention to provide a dirt separation container including a shroud with a downwardly projection skirt to improve dirt separation.

A further object of the invention is to provide an air separation and dirt collection container with a shroud and a separate filter chamber above the shroud for use with a vacuum cleaner having a vacuum source in the upper portion of the vacuum housing.

Yet another object of the invention is to provide a compact vacuum cleaner with an easily removable pleated filter cartridge positioned outside and above the shroud and below the vacuum source.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings(s), in which.

DETAILED DESCRIPTION OF THE INVENTION

Figure 1:
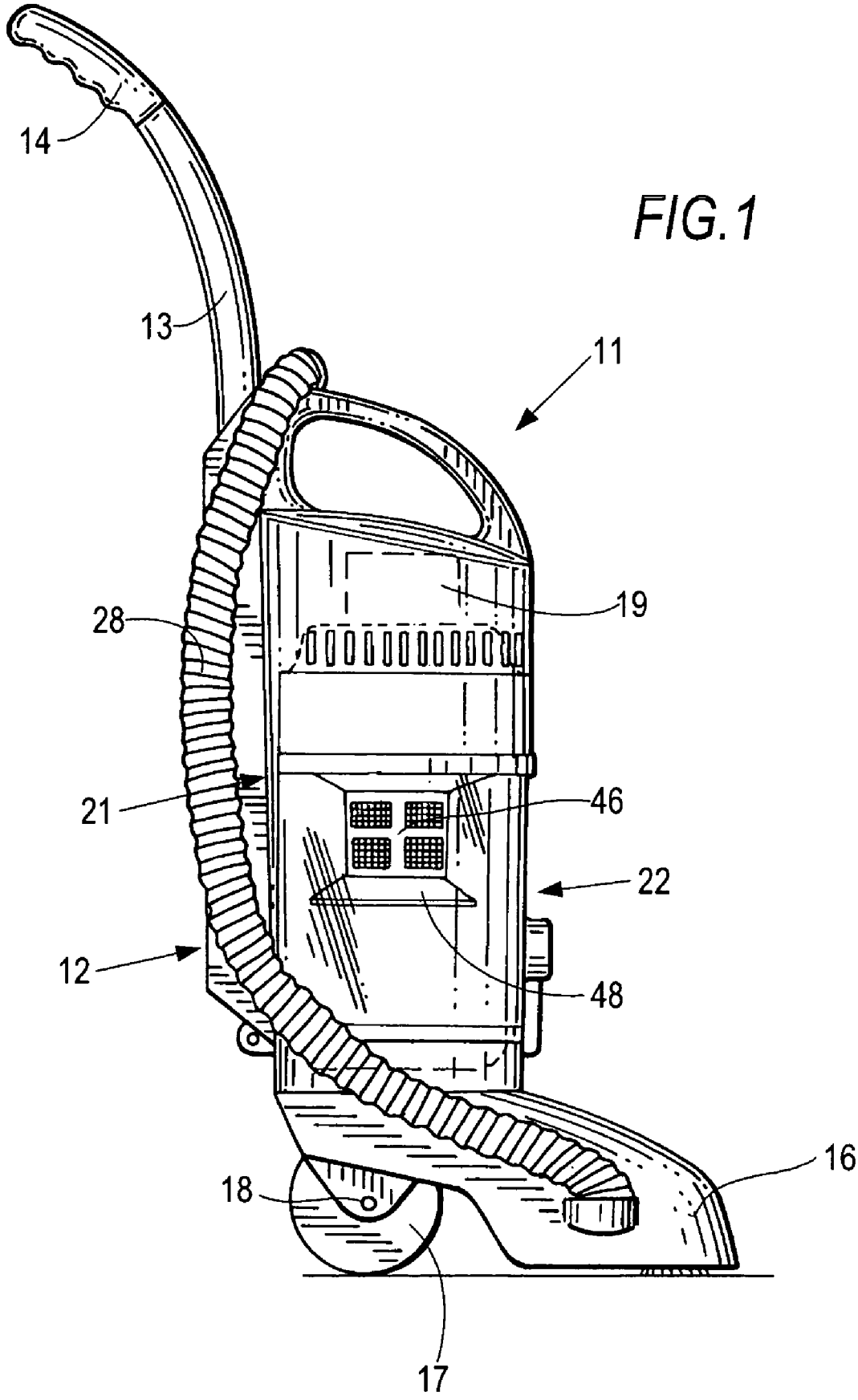
FIG. 1 is a side elevational view of a compact upright vacuum cleaner with a removable cylindrical cyclonic air separation and collection container and a cylindrical filter cartridge constructed and arranged in accordance with the invention.

FIG. 1 shows the main components of a light weight vacuum cleaner 11 constructed and arranged in accordance with the invention. Vacuum cleaner 11 has an elongated housing 12 with an upwardly extending pipe 13 terminating in a user handle 14. An air separation and dirt collection container cavity 21 is formed in the lower portion of housing 12. A suction nozzle 16 is hingedly connected to housing 12 for passing over a surface to be cleaned. A pair of wheels 17 or rollers are mounted at the bottom rear of housing 12 on an axle 18 for ease of displacing over the surface to be cleaned. A vacuum motor 19 is positioned in the upper portion of housing 12 above container cavity 21.

A selectively removable cylindrical air separation and collection container 22 is positioned in cavity 21 of housing 12. As shown in more detail in FIG. 2, air separation and collection container 22 has a substantially cylindrical sidewall 26 and a cover 31 with a handle 29 and a selectively openable hinged bottom 23. Sidewall 26 has an air inlet 27 in the upper portion. A conduit 28 provides an airflow connection from nozzle 16 to inlet 27. A combination shroud and filter holder assembly 24 is seated at the upper portion of container 22. A filter cartridge 52 is positioned in housing 12 below motor 19.

Referring again to FIG. 2, air separation and collection container 22 has a cover 31 with an open top 33. A pivotable latch 36 with an engagement lip 37 at the lower end and a release button 38 at the top by a pin 39 is mounted to the front of sidewall 26 by a pin 39. Latch 36 is biased at the top by a spring 41 to engage bottom 23 and hold it in a closed position during vacuuming and removal from cavity 21. Bottom 23 is fitted with a gasket 42 to insure an airtight connection with sidewall 26 when closed.

Combination shroud and filter holder 24 includes a lower cylindrical shroud portion 46 with a closed bottom with an outwardly extending and downwardly facing skirt 48 on the closed bottom that extends to about the mid-point of cylindrical container 22. Shroud 46 need not extent to the exact midpoint of container 22, but should be within about plus or minus 10 percent of the height of container 22. This will allow for sufficient air separation above skirt 48 and retention of dirt collected below skirt 48. A funnel-shaped or frusto-conical transition portion 49 extends from the top of shroud 46 to a height of the top of sidewall 26 and extends upwardly to form a cylindrical filter holder portion 51.

Figure 3:
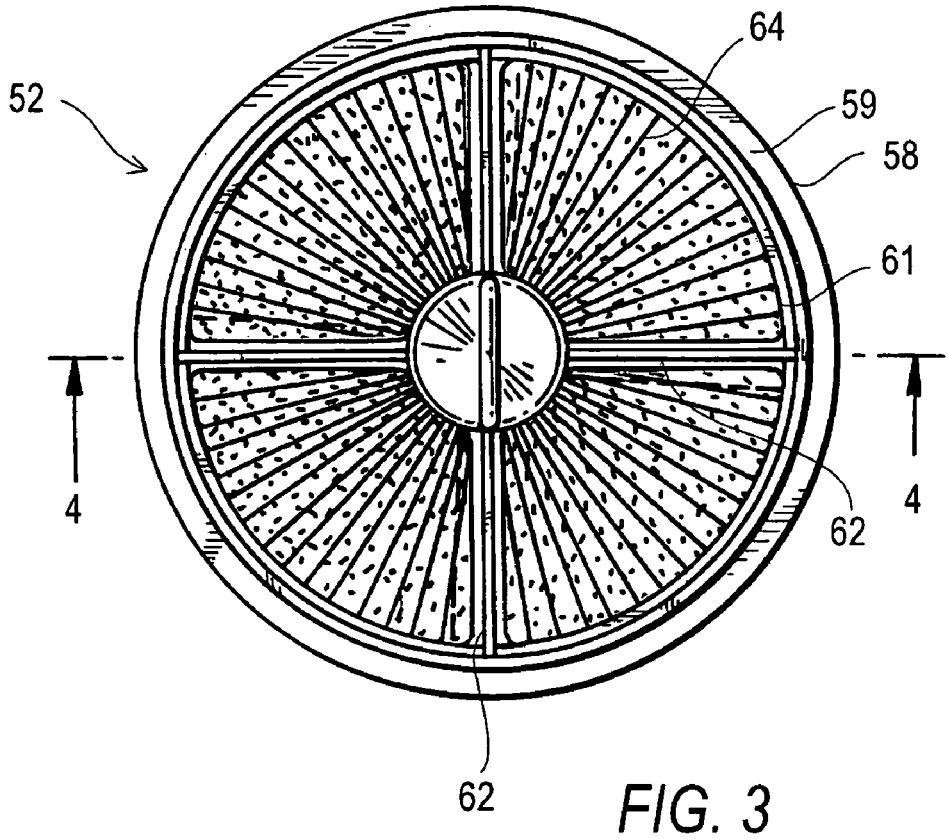
FIG. 3 is a top plan view of the pleated filter cartridge positioned in the shroud and filter holder of FIG. 2 taken along line 3-3.
Figure 4:
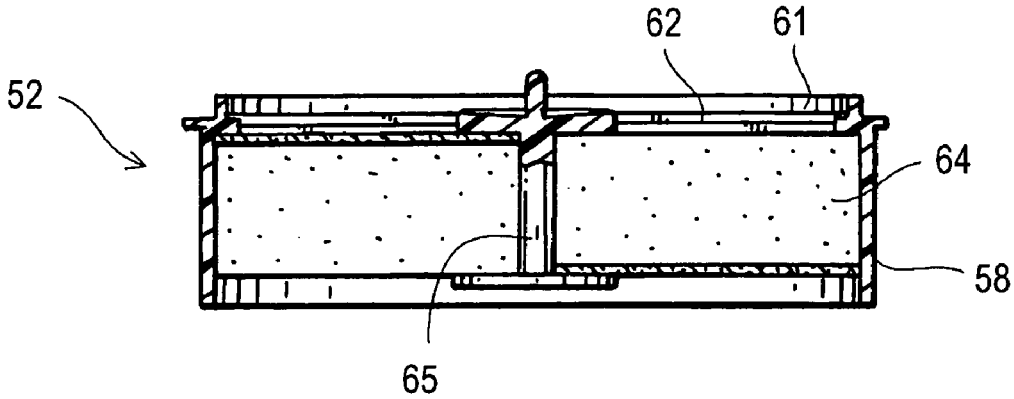
FIG. 4 is cross-sectional view of the filter cartridge of FIG. 3 taken along line 4-4.

Filter holder portion 51 holds a radially plated filter cartridge 52 shown in detail in FIGS. 3 and 4. A cover 31 fits over filter holder portion 51. Sidewall 26 includes three tabs (not shown) that are engaged by three corresponding key slots formed on the inside of cover 31 for providing a secure locking engagement between cover 31 and sidewall 26 when assembled for use. This also allows for easy removal for cleaning or replacement of filter cartridge 52. A gasket 56 is also provided at the sidewall of cover 31 for forming a seal with filter cartridge 52.

Filter cartridge 52 includes a cylindrical sidewall 58 and is open at the top and bottom. The top of sidewall 58 has an inwardly facing flange 59 and an upwardly extending edge 61 for contacting gasket 56 in cover 31 to form a seal. A pair of cross-hatch beams 62 provide support and hold a center pin 63 with a lower button 65 for securing a pleated filter element 64 in place.

The filter media may be a high density polyethylene-based open-celled porous media, such as Porex, or air equivalent foraminous filter. A suitable filter medial is a rigid open-celled foam that is moldable or washable into a desired configurations. Preferably, the filter media is a high efficiency particular arrest (HEPA) filter element in radial pleated form with in cartridge 52.

Figure 2:
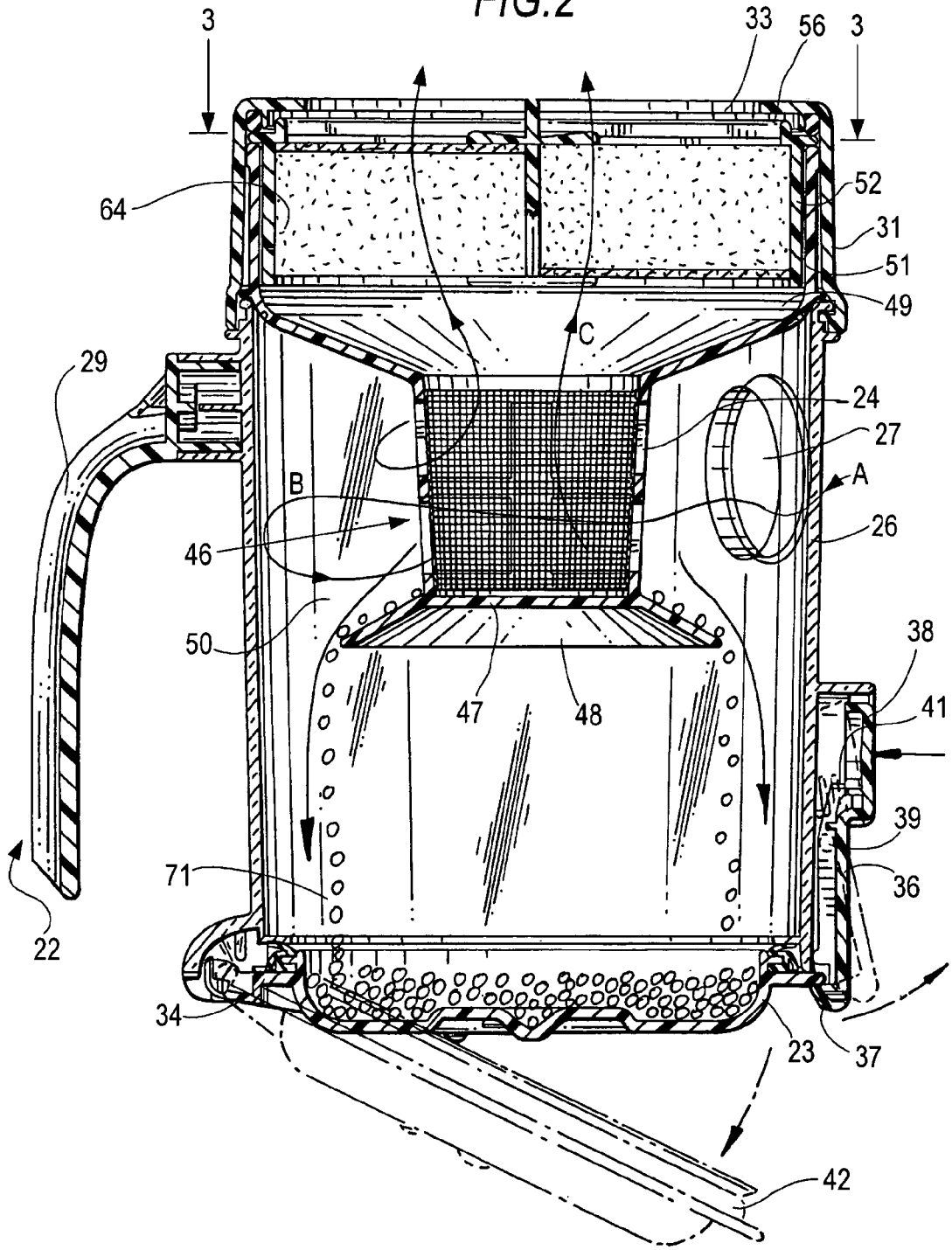
FIG. 2 a cross-sectional view of the separation and collection container with the shroud and filter holder in place for use in the vacuum cleaner of FIG. 1 showing the air and dirt pattern.
Figure 5:
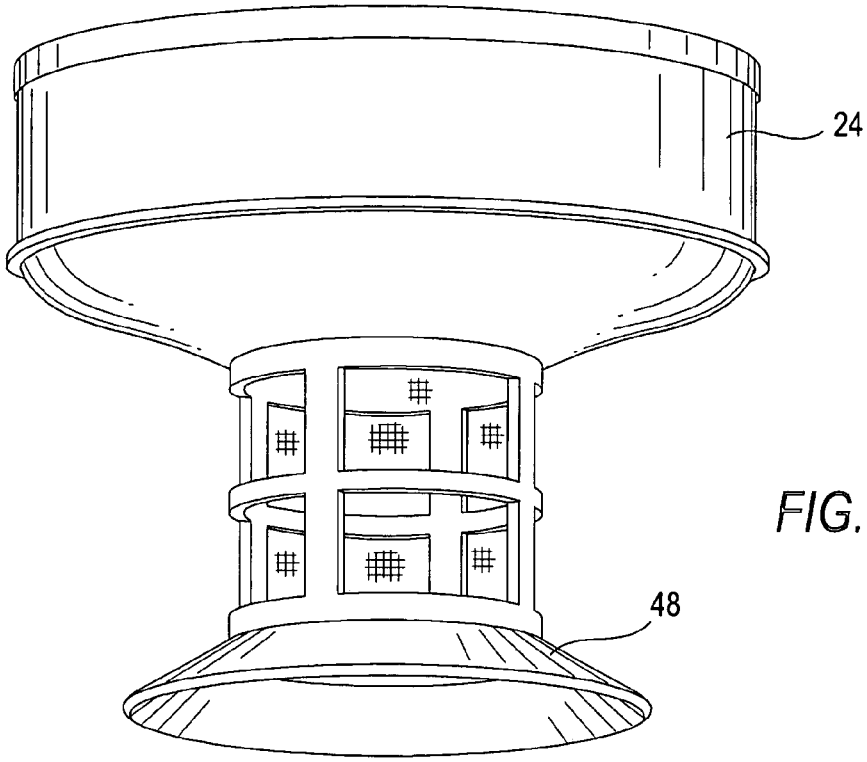
FIG. 5 is a perspective view of the combination shroud and filter holder in the container of FIG. 2.
Figure 6:
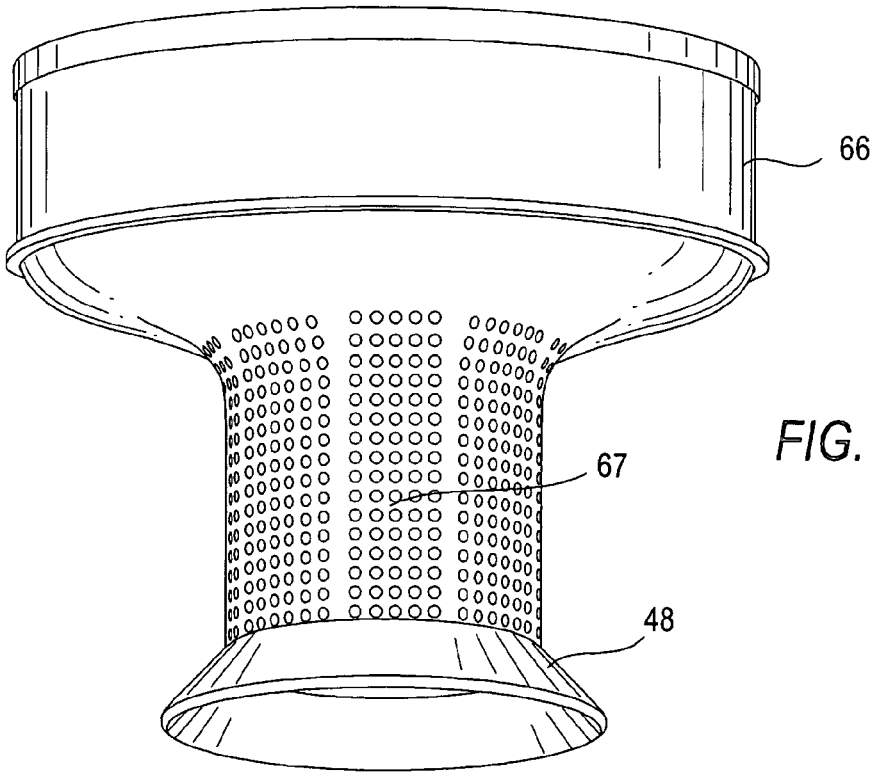
FIG. 6 is a perspective view of a combination shroud and filter holder in accordance with another embodiment of the invention.

Shroud portion 46 between skirt 48 and transition portion 49 is open to airflow to filter holder region 51. A screen 50 is placed over opening in shroud 46 to prevent large pieces of debris and fibers from clogging filter element 64. Details of shroud 46 illustrated in FIG. 2 are shown in perspective in FIG. 5. FIG. 6 illustrates another embodiment of a combined shroud and filter holder assembly 66 with a plurality of holes 67 in place of the open shroud and screen 50 of combination holder 24 of FIG. 5.

FIG. 2 illustrates the air flow pattern and dirt collection of air separation and collection container 22 constructed in accordance with the invention. Dirty air enters nozzle 16 and travels up conduit 28 to inlet 27 as shown by an arrow A. Air then travels tangentially within sidewall 26 of the collection container 22 as shown by an arrow B and dirt 71 is collected on bottom 23. Clean air shown by arrow C is then drawn through screen 50 into transition region 49. Air is then drawn through outlet 33 and into filter cartridge 52 due to the vacuum created by motor 19 above filter holder 24. A washable foam filter disk can be positioned at the inlet to motor 19 as a final filter.

In the illustrated embodiment, compact vacuum cleaner 11 is about 1.25 meter or 48 inches in height with container 22 having a diameter of about 108 mm or 4⅜ inches. Shroud 46 has an outer diameter of about 43 mm. Skirt 48 is positioned at the bottom of shroud 46 and extends about 16.6 mm from the outer diameter of shroud 46. Thus, skirt 48 extends to between about 60 to 80 percent of the inside diameter of sidewall 26. Preferably, skirt 36 should extend about 65 to 75 percent, and most preferably about 70 percent. The overall height of container 21 is about 25 cm. Filter cartridge 52 is about 3.5 cm in height.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawings(s) shall be interpreted as illustrative and not in a limiting sense.

It is also to be understood that the following claims are intended to cover all of the generic and specific features of the invention herein described and all statements of the scope of the invention that as a matter of language, might be said to fall there between.

What is claimed is:

1. An air separation and dirt collection device for a bagless vacuum cleaner comprising:

an elongated container having a cylindrical sidewall, a open top and a closed bottom that is openable for emptying collected dirt;

a tangential air inlet formed in the upper portion of the sidewall;

a combined shroud and filter holder assembly, the shroud having an open sidewall and closed bottom with an outwardly and downwardly extending skirt disposed on the closed bottom of the shroud;

an inverted frusto-conical transition portion extending from the upper portion of the shroud to the filter holder portion extending above the upper portion of the container sidewall and being open to passage of air; and a radially pleated filter cartridge positioned in the filter holder portion of the assembly.

2. The air separation and dirt collection device of claim 1, wherein the outer diameter of the skirt extends to between about 60 to 80 percent of the diameter of the cylindrical container.

3. The air separation and dirt collection device of claim 1, wherein the shroud has an outer diameter between about 35 to 45 percent of the diameter of the container sidewall.

4. The air separation and dirt collection device of claim 1, wherein the bottom is hinged to the sidewall and selectively openable for removal of dirt collected thereon.

5. The air separation and dirt collection device of claim 1, including a screen on the open sidewall of the shroud.

6. The air separation and dirt collection device of claim 1, wherein the sidewall of the shroud includes a plurality of holes.

7. The air separation and dirt collection device of claim 6, wherein the filter cartridge includes a radially pleated filter.

8. The air separation and dirt collection device of claim 6, wherein the pleated filter is a HEPA filter.

9. A vacuum cleaner including an elongated housing hingedly connected to a suction nozzle with a dirty air inlet and a suction source in the upper portion and having an opening for receiving a dirt separation and collection container, the container comprising:

an elongated container having a cylindrical sidewall, a open top and a closed bottom that is openable for emptying collected dirt;

a tangential air inlet formed in the upper portion of the sidewall;

a combined shroud and filter holder assembly, the shroud having an open sidewall and closed bottom with an outwardly and downwardly extending skirt disposed on the closed bottom of the shroud;

an inverted frusto-conical transition portion extending from the upper portion of the shroud to the filter holder portion extending above the upper portion of the container sidewall and being open to passage of air; and a radially pleated filter cartridge positioned in the filter holder portion of the assembly.

* * * * *